US007445433B2

(12) United States Patent
Chivers et al.

(10) Patent No.: US 7,445,433 B2
(45) Date of Patent: Nov. 4, 2008

(54) FAN OR COMPRESSOR BLISK

(75) Inventors: Nigel J D Chivers, Wiltshire (GB); Paul Spencer Topliss, Bristol (GB)

(73) Assignee: Rolls-Royce plc, London (GB)

( * ) Notice: Subject to any disclaimer, the term of this patent is extended or adjusted under 35 U.S.C. 154(b) by 595 days.

(21) Appl. No.: 11/065,128

(22) Filed: Feb. 24, 2005

(65) Prior Publication Data

US 2005/0186080 A1 Aug. 25, 2005

(30) Foreign Application Priority Data

Feb. 24, 2004 (GB) ..... 0404036.6

(51) Int. Cl.
*F01D 5/34* (2006.01)

(52) U.S. Cl. ..... 416/193 A; 416/234; 416/244 A

(58) Field of Classification Search ..... 416/234, 416/244 A, 193 A

See application file for complete search history.

(56) References Cited

U.S. PATENT DOCUMENTS 4,312,625 A 1/1982 Pinaire
5,292,385 A 3/1994 Kington
6,511,294 B1 * 1/2003 Mielke et al. ..... 416/193 A
6,524,070 B1 * 2/2003 Carter ..... 416/193 A

FOREIGN PATENT DOCUMENTS

EP 1 087 100 A2 3/2001
EP 1 188 900 A2 3/2002

* cited by examiner

*Primary Examiner*—Richard Edgar
(74) *Attorney, Agent, or Firm*—Oliff & Berrdige, PLC

(57) ABSTRACT

A fan or compressor blisk for a gas turbine engine, lift fan or the like, comprises a disc having a radially outer rim, and a plurality of aerofoil blades circumferentially spaced around and extending radially outwards from the rim. The rim has a radially inward facing surface on its underside on at least one side of the disc, the radially inward facing surface having at least one indentation for reducing the cross-sectional area of the rim, in the circumferential direction of the disc, in the region of the indentation.

11 Claims, 2 Drawing Sheets

FAN OR COMPRESSOR BLISK

This invention relates generally to gas turbine engines, lift fans and the like, and in particular concerns bladed integral discs for a lift fan or the fan or axial flow compressor of a gas turbine engine.

Recent improvements in manufacturing technology, notably friction welding, have enabled integral bladed disc rotors, also referred to as blisks, or bliscs, to be manufactured with the disc rotor integrally formed with the rotor blades. Metal alloy blisks may be machined from solid, but more usually the blades are friction welded to the rim of the disc. Blisks have a number of advantages when compared with more traditional bladed disc rotor assemblies. In particular, blisks are generally lighter than equivalent bladed disc assemblies since traditional blade to disc mounting features, such as dovetail rim slots and blade roots, are no longer required. Blisks are therefore increasingly used in axial flow compressors of modern gas turbine engines.

In known blisk arrangements root fillet radii are provided around the root of the aerofoil blades where the blades are attached to the rim of the disc. The root fillets provide a smooth transition between the radially outer surface of the disc rim and the blade aerofoil surfaces. The root fillets act to reduce the concentration of circumferential stress at the blade root/disc interface when the blisk rotates.

During engine operation the aerofoil blades tend to untwist about their respective spanwise axis due to the effect of the engine airflow on the blades. It has been found that this untwisting results in the generation of high stresses in the root fillet, principally at the trailing and/or leading edge(s) of the blades since these points are furthest from the spanwise axis of the blade about which untwisting occurs.

There is a requirement therefore for an improved blisk design where the stress concentration at the blade root fillet due to aerofoil untwisting is reduced. This is achieved in the present invention by the local reduction of the rim cross-section area in the circumferential direction of the disc.

The present invention contemplates a blisk for the fan or compressor section of a gas turbine engine and also a blisk for the rotor of a lift fan or the like.

According to an aspect of the present invention there is provided a fan or compressor blisk for a gas turbine engine, lift fan or the like, the blisk comprising a disc having a radially outer rim, and a plurality of aerofoil blades circumferentially spaced around and extending radially outwards from the outer surface of the rim, the rim having a radially inward facing surface on the underside of the rim on at least one side of the disc, the said radially inward facing surface having at least one indentation for reducing the cross-sectional area of the rim, in the circumferential direction of the disc, in the region of the said indentation.

The ability of the disc rim to support circumferential hoop stress is considerably reduced by the indentation or indentations in the rim. The local reduction in cross-section allows the disc rim to bend locally and relieve the steady stresses that occur, in use, in the blade fillet due to blade untwisting.

Preferably the indentation(s) is/are located on the underside of the disc rim between adjacent aerofoils. By removing material on the underside of the disc rim to form the indentations the radial thickness of the disc rim in the region of the blade root fillets is maintained while the radial thickness of the disc rim between adjacent blades in the region of the indentations is reduced. The indentations reduce the cross sectional area, and hence load carrying capability of the rim, in the circumferential direction of the disc.

In preferred embodiments, a plurality of indentations are provided on the underside of the rim with at least one indentation located between each pair of adjacent aerofoils. In this way the stress concentration at the blade root fillet can be minimised.

Preferably, the indentations are centred approximately mid way between respective adjacent aerofoils. This provides for substantially even loading of the disc rim in the region of the indentations due to centrifugal loads acting on the disc as the blisk rotates.

Preferably the rim comprises a radially inward facing surface on both the aerofoil leading edge and trailing edge side of the disc and that indentations are provided between adjacent aerofoils on one or both of the inward facing surfaces. Preferably indentations are provided on the underside of the disc rim in the region of the aerofoil leading edge and the trailing edge of the rim. In this way the indentations partially remove the hoop continuity from the sections of the disc rim that support the aerofoil leading and trailing edges. This shields the aerofoil leading and trailing edge parts of the disc rim from the circumferential stress supported by the disc and also reduces the peak stress in the blade fillet at the leading and trailing edge when the blisk rotates.

In preferred embodiments each indentation comprises a depression in the radially inward facing surface of the rim in which it is formed. The depressions are preferably in the form of an undercut or cut-away portion of the underside of the disc rim.

In preferred embodiments the depressions have a generally concave curvature in the circumferential and/or axial direction of the disc. The concave shape of the depressions reduces the stress concentration between the hoop-continuous portion of the disc rim and the non-continuous portion in which the indentations are formed.

In preferred embodiments the depth of the depression is in the region of about 10-20% of the radial thickness dimension of the disc rim in the region of the rim in which the depression is formed.

According to another aspect of the invention there is provided a gas turbine engine or lift fan comprising a blisk in accordance with the first aspect of the invention.

Various embodiments of the invention will now be more particularly described, by way of example only, with reference to the accompanying drawings, in which.

Figure 2:
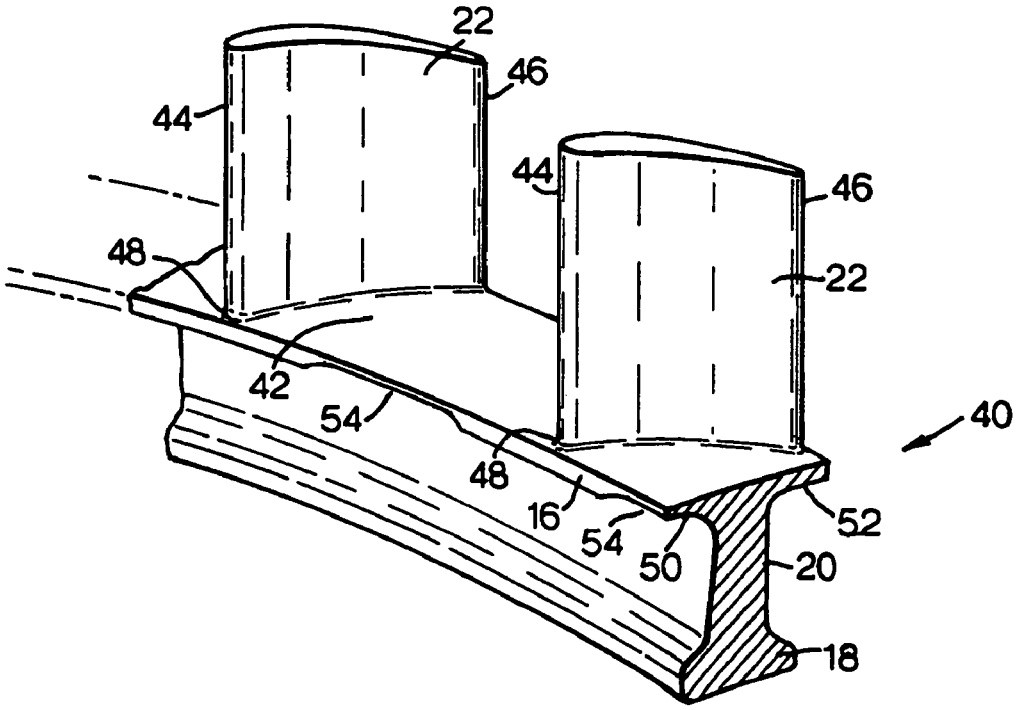
FIG. 2 is a perspective view of a circumferential section of a rotor blisk for a gas turbine engine compressor or lift fan.
Figure 3:
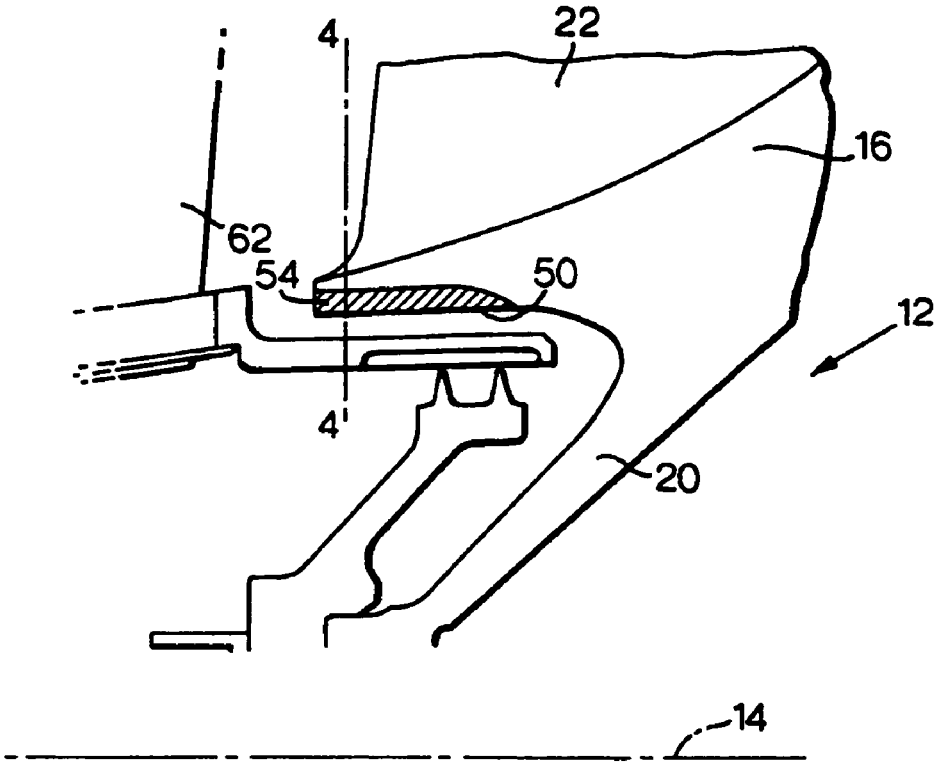
Figure 4:
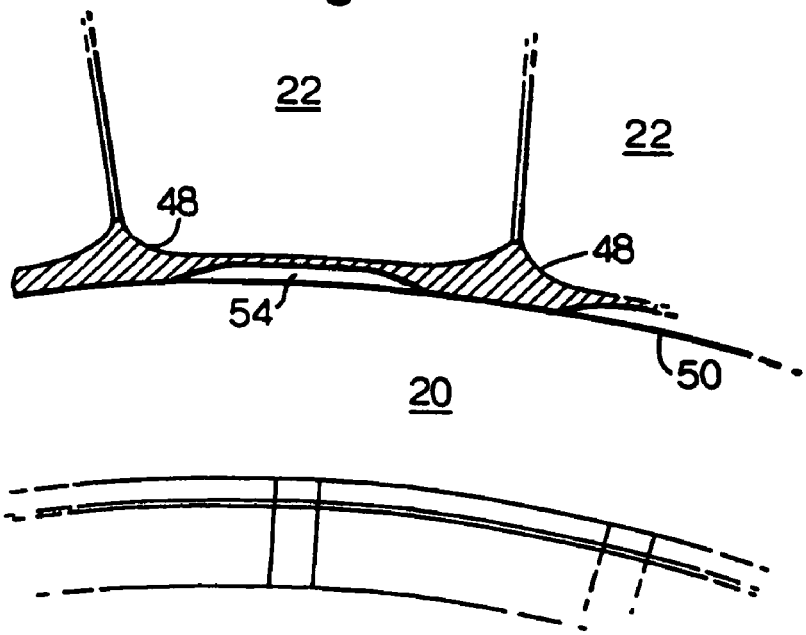

FIG. 3 is a cross section axi-symetric view of a lift fan rotor incorporating a blisk according to an embodiment of the present invention; and FIG. 4 is a cross section view of the blisk of FIG. 3 along line 4-4. Same or similar elements shown in the illustrated embodiments in the drawings of FIGS. 1 to 4 are identified by the same reference numerals in the drawings and in the description that follows.

Figure 1:
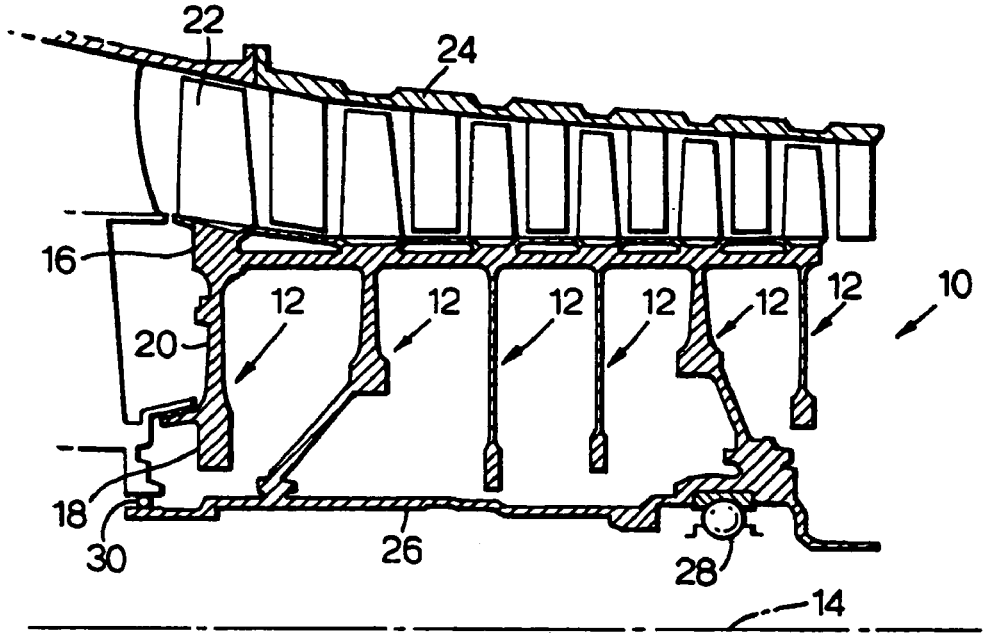
FIG. 1 is a schematic representation of a gas turbine engine compressor rotor including a plurality of blisks.

Referring to FIG. 1, there is shown an axial flow compressor rotor assembly 10 for a gas turbine engine. The rotor assembly 10 comprises a plurality of rotors 12 coaxially disposed and joined together for rotation about engine axis 14. Each rotor includes a radially outer rim 16 and a radially inner hub 18 with a web portion 20 extending radially between the rim around the hub. A plurality of circumferentially spaced compressor rotor blades 22 extend radially from the rim towards the compressor casing 24. The rotors are welded together, close to their respective rim portions 16, to provide an integral drum type structure that is connected to a common rotor shaft 26 supported in ball and roller bearings 28 and 30 for rotation about the engine axis.

The rim, web and hub portions of each rotor 12 constitute a disk for supporting the centrifugal loads of the rotor blades when the compressor 10 rotates. In the compressor assembly 10 at least one of the rotors is in the form of the blisk, that is to say an integrally bladed disk in which the rotor blades 22 are integrally joined, for example by friction welding, to the rim 16 of the disk part of the rotor blisk. At least one of the rotors may have removable blades secured to the rim of the disk part of the rotor by conventional fixings such as dovetail slots and roots.

Referring now to FIG. 2 which shows a circumferential portion of an integrally bladed disk 40 constructed in accordance with an embodiment of the present invention. The view of FIG. 2 is a forward view, that is to say, the blisk is viewed from the upstream side of the blisk. In the embodiment of FIG. 2 the disk portion of the blisk has an approximate I-shaped symmetric cross section with wider rim and hub portions 16 and 18 connected by a narrower web section 20.

The rotor blades 22, only two of which are shown in the drawing on FIG. 2, extend radially outwards from the radially outer gas washed surface 42 of the rim with the respective leading and trailing edges 44 and 46 of the blades positioned at the respective axial ends of the rim 18. A fillet radius 48 is provided at the blade/rim interface around the periphery of each of the blades to reduce stress concentration at this surface discontinuity in use. This results in the rim 16 extending slightly forward of the blade leading edges 44 and slightly rearward of the trailing edges 22 in the axial direction of the blisk. The rim 16 overhangs the web section 20 on both sides of the blisk such that radially inward facing surfaces 50 and 52 are defined on the underside of the rim between the web 20 and the respective upstream and downstream axial extremities of the rim.

The radially inward facing surfaces 50 and 52 are scalloped at various points on their circumference to provide a series of circumferentially spaced indentations 54 which locally reduce the cross-sectioned area of the rim where the indentations are provided. The indentations are of a similar shape and size and are in the form of concave depressions in the respective radially inward facing surfaces. The indentations extend from close to the surface of the web to the respective axial ends of the rim where they open into the respective upstream and downstream axial edges of the rim between the radially outer surface 42 and the respective inward facing surfaces 50 and 52. In the embodiment of FIG. 2 a single indentation 54 is provided in each surface 50 and 52 on the underside of the rim between each pair of adjacent aerofoils 22. The indentations extend circumferentially over the majority of the circumference between adjacent aerofoils so that the regions of the rim between the aerofoils in proximity to the aerofoil leading and trailing edges have reduced stiffness. The indentations reduce the capacity of the rim to carry hoop stress generated by the centrifugal loads of aerofoils in use. This allows the disk rim to bend locally to relieve steady state stresses that are generated in the blade fillet 48 by the twisting motion of the aerofoil as it untwists due to the pressure of the working fluid acting on the blades wherein the blades rotate.

The indentations 54 are centred between adjacent aerofoils and have a generally concave curvature in both the circumferential and axial direction of the disk. Although it is not clear from the drawing of FIG. 2 the depth of each indentation varies in the axial direction of the disk from a maximum at the respective upstream or downstream edge of the rim to a minimum towards the web of the disk. These features may be more readily apparent from the embodiment shown in the drawings of FIGS. 3 and 4.

Referring to FIGS. 3 and 4, in another embodiment of the present invention, a lift fan rotor assembly comprises a rotor 12 positioned downstream of an array of stator vanes 62. In the drawing of FIG. 3 only the upstream side of the rotor 12 is shown, the remaining detail of the downstream side of the rotor is omitted. Likewise only part of the rotor blade 22 is shown, that is the radially inner part of the blade in proximity to the radially outer surface of the disc rim. The trailing edge part of the blade has is also omitted.

The rotor 12 shown in FIG. 3 is an integrally bladed disc or blisk as previously described. In this arrangement the rim 16 is considerably wider than the web portion 20 so that the rim can accommodate relatively wide chord rotor blades 22. At the forward, or upstream, edge of the rim the radially inward facing surface 50 is provided with a series of circumferentially spaced indentations 54 as previously described with reference to the embodiment of FIG. 2. The indentations extend, in the axial direction of the blisk, from the upstream edge of the rim towards the upstream face of the web 20. The indentations constitute flat concave depressions in the radially inward facing surface. In the axi-symmetric part cross-section view of FIG. 3 it can be seen that each indentation has a relatively constant radial depth dimension in the axial direction of the blisk, tapering gently towards the radially inward facing surface 50 at the axial end of the indentation nearest the web 20. In the embodiment of FIG. 3 the radially inward facing surface 50 is substantially cylindrical and coaxially disposed about the rotor axis 14. The cylindrical surface curves gently to merge with the forward facing surface of the web. The indentations are provided substantially in the cylindrical part of the inward facing surface 50 with axial end of each indentation corresponding to the transition point between the flat cylindrical part and the curved part of that surface.

Referring now to FIG. 4, each indentation 54 has a substantially flat concave cross-section in the plane of the rotor orthogonal to the rotor axis. The indentations are centred substantially between adjacent aerofoils such that the radial thickness of the forward edge of the rim at the aerofoil leading edges is a minimum between the aerofoil blades and a maximum at the circumferential positions of the blades. The radial depth of each indentation is substantially constant over the majority of the circumferential distance of the indentation, with the indentation tapering out to the inward facing cylindrical surface at the circumferential edges of the indentation. As can be seen from the drawing of FIG. 4 the radius of curvature of the concave circumferential edges of the indentations is slightly less than the curvature of the fillet radii 48 at the blade/rim interface.

Although aspects of the invention have been described with reference to the embodiments shown in the accompanying drawing, it is to be understood that the invention is not limited to those precise embodiments and that various changes and modifications may be effected without further inventive skill and effort.

The invention claimed is:

1. A fan or compressor blisk for a gas turbine engine, lift fan or the like, the blisk comprising:

a disc having a hub, a radially outer rim, a web extending between the hub and the rim, and a plurality of aerofoil blades circumferentially spaced around and extending radially outwards from an outer surface of the rim, the rim having a radially inward facing surface on an underside of the rim on at least one side of the disc, the radially inward facing surface having at least one indentation with a relatively constant radial depth in an axial direction of the blisk for reducing a cross-sectional area of the rim, in a circumferential direction of the disc, in the region of the indentation.

2. A blisk as claimed in claim 1 wherein the indentation comprises a depression in the surface of the rim in which it is formed.

3. A blisk as claimed in claim 2 wherein at least part of the surface of the depression has a generally concave curvature in the circumferential and/or axial direction of the disc.

4. A blisk as claimed in claim 2 wherein the depth of the depression varies in the axial direction of the disc from a maximum at the respective edge of the rim to a minimum towards the web of the disc.

5. A blisk as claimed in claim 1 wherein the depth of the indentation is in the region of 10 to 20 per cent of the radial thickness dimension of the rim in the region in which the indentation is formed.

6. A gas turbine engine or lift fan comprising a blisk as claimed in claim 1.

7. A blisk as claimed in claim 1 wherein the at least one indentation is located on the underside of the rim between adjacent aerofoils.

8. A blisk as claimed in claim 7 wherein a plurality of indentations are provided on the underside of the rim with at least one indentation located between each pair of adjacent aerofoils.

9. A blisk as claimed in claim 8 wherein the indentations are centered approximately midway between respective adjacent aero foils.

10. A blisk as claimed in claim 8 wherein the rim comprises a radially inward facing surface on both the aerofoil leading edge and trailing edge side of the disc and the indentations are provided between adjacent aerofoils on one or both of the inward facing surfaces.

11. A blisk as claimed in claim 10 wherein the indentations are provided on the underside of the rim adjacent the aerofoil leading and/or trailing edges.

* * * * *